US009784063B2

(12) United States Patent
June et al.

(10) Patent No.: US 9,784,063 B2
(45) Date of Patent: Oct. 10, 2017

(54) SUBSEA PRODUCTION SYSTEM WITH DOWNHOLE EQUIPMENT SUSPENSION SYSTEM

(75) Inventors: David R. June, Houston, TX (US); David H. Theiss, Houston, TX (US); Paul S. Tetley, Katy, TX (US); Scott D. Ward, Houston, TX (US); Jack H. Vincent, Katy, TX (US)

(73) Assignee: OneSubsea IP UK Limited, London (GB)

( * ) Notice: Subject to any disclaimer, the term of this patent is extended or adjusted under 35 U.S.C. 154(b) by 289 days.

(21) Appl. No.: 13/588,951

(22) Filed: Aug. 17, 2012

(65) Prior Publication Data

US 2014/0048277 A1 Feb. 20, 2014

(51) Int. Cl.

| | |
|---|---|
| ***E21B 33/04*** | (2006.01) |
| ***E21B 33/035*** | (2006.01) |
| ***E21B 33/038*** | (2006.01) |
| ***E21B 33/043*** | (2006.01) |
| ***E21B 43/12*** | (2006.01) |

(52) U.S. Cl.

CPC ..... *E21B 33/035* (2013.01); *E21B 33/038* (2013.01); *E21B 33/043* (2013.01); *E21B 33/0407* (2013.01); *E21B 43/128* (2013.01)

(58) Field of Classification Search

CPC ..... E21B 33/035; E21B 33/043; E21B 43/128

USPC ..... 166/338, 348, 368, 382, 75.14

See application file for complete search history.

(56) References Cited

U.S. PATENT DOCUMENTS

| | | | | |
|---|---|---|---|---|
| 4,331,203 | A * | 5/1982 | Kiefer | E21B 33/076 166/339 |
| 4,475,600 | A | 10/1984 | Cegielski et al. | |
| 5,372,199 | A * | 12/1994 | Cegielski et al. | 166/368 |
| 6,474,417 | B1 * | 11/2002 | Blair et al. | 166/368 |
| 6,776,230 | B2 | 8/2004 | Collie et al. | |
| 2004/0094311 | A2 | 5/2004 | Hopper et al. | |
| 2005/0016735 | A1 | 1/2005 | Ireland et al. | |
| 2007/0289747 | A1 * | 12/2007 | Shaw et al. | 166/368 |
| 2011/0300008 | A1 | 12/2011 | Fielder et al. | |
| 2012/0024536 | A1 | 2/2012 | Given et al. | |

FOREIGN PATENT DOCUMENTS

EP 2 225 436 B1 2/2012

OTHER PUBLICATIONS

International Search Report and Written Opinion dated Nov. 7, 2013 for PCT Application No. PCT/US2013/054829 filed Aug. 14, 2013.

* cited by examiner

*Primary Examiner* — Matthew R Buck
*Assistant Examiner* — Patrick Lambe
(74) *Attorney, Agent, or Firm* — Chamberlain Hrdlicka

(57) ABSTRACT

A subsea production system for a well including a subsea production tree, a tubing hanger, and a production tubing extending into the well and supported by the tubing hanger. A downhole equipment suspension system includes a suspension head supported directly or indirectly by the production tree above and separately from the tubing hanger. The suspension system also includes downhole equipment inside the production tubing below the tubing hanger and a suspension line extending through the tubing hanger vertical production bore and the production tree vertical bore. The suspension line suspends the downhole equipment from the suspension head.

28 Claims, 7 Drawing Sheets

SUBSEA PRODUCTION SYSTEM WITH DOWNHOLE EQUIPMENT SUSPENSION SYSTEM

BACKGROUND

Drilling and producing offshore oil and gas wells includes the use of offshore facilities for the exploitation of undersea petroleum and natural gas deposits. A typical subsea system for drilling and producing offshore oil and gas can include the installation of an electrical submersible pumping system (ESP) that can be used to assist in production.

Normally, when ESPs are used with wells, they are used during production to provide a relatively efficient form of "artificial lift" by pumping the production fluids from the wells. By decreasing the pressure at the bottom of the well bore below the pump, significantly more oil can be produced from the well when compared with natural production.

ESPs include both surface components (housed in the production facility or an oil platform) and sub-surface components found in the well. The surface components include the motor controller (which can be a variable speed controller) and surface cables and transformers. Subsurface components typically include the pump, motor, seal, and cables. Sometimes, a liquid/gas separator is also installed. The pump itself may be a multi-stage unit with the number of stages being determined by the operating requirements. Each stage includes a driven impeller and a diffuser that directs flow to the next stage of the pump. The energy to run the ESP pumpcomes from a high-voltage alternating-current source connected with the ESP pump via electrical cable from the surface.

Typically, for subsea structures, horizontal trees have been considered the best arrangement for supplying electricity to an ESP pump suspended on the production tubing. However, at least one problem exists with using a horizontal tree for supplying electricity to an ESP pump: if a horizontal tree is to be recovered for any reason, the tubing hanger must be recovered first, as it sits above or on the horizontal tree. This could be very costly to perform, and thus, a key reason why a more cost effective method is desirable. A tubing hanger recovery requires a very costly drilling rig since well pressure control and large bore access is mandatory. Tubing hanger recovery and successful re-completion of the downhole assembly involves significant risk.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
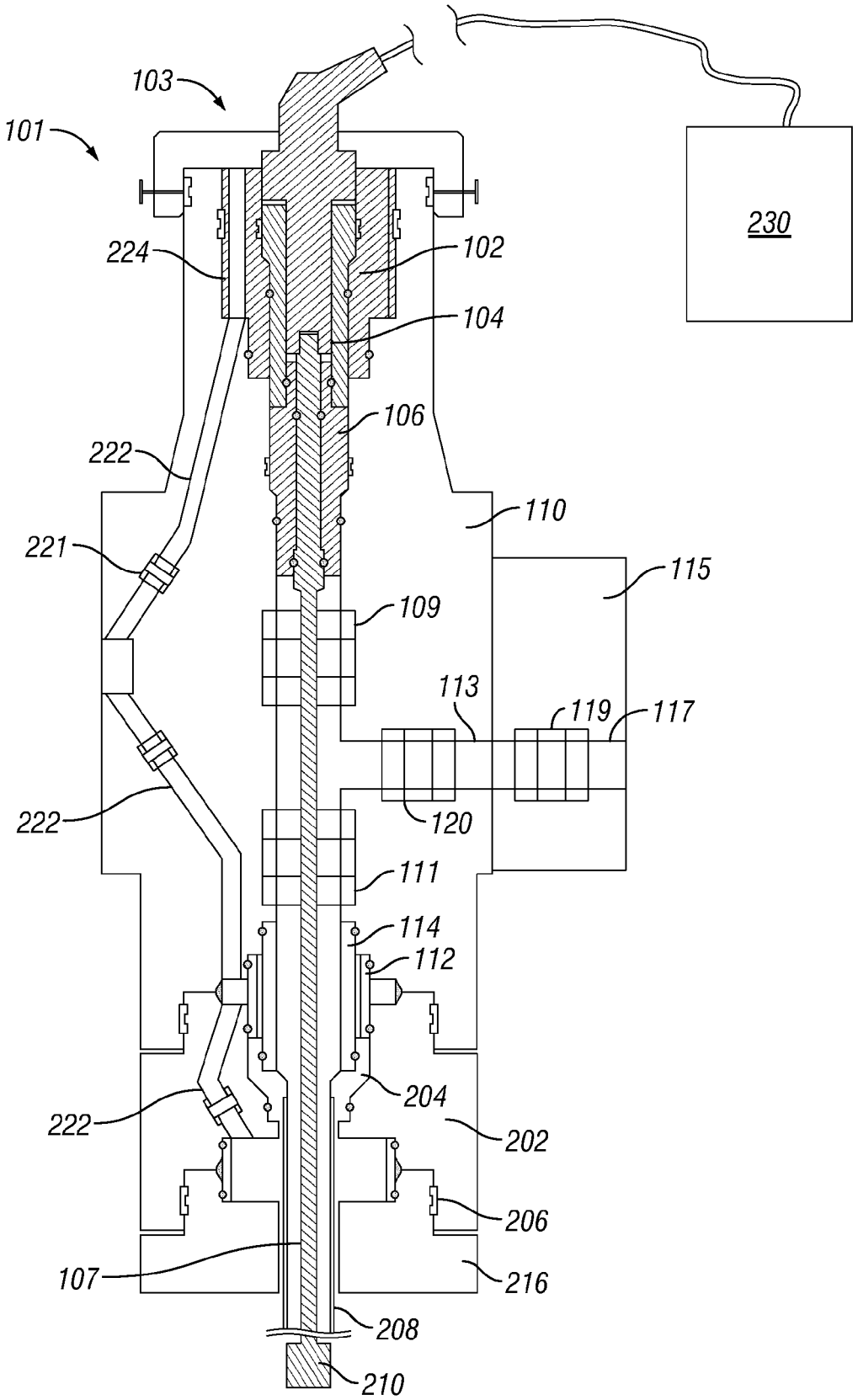
FIG. 1 shows an embodiment of a production system with a vertical production tree and a downhole equipment suspension system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Accordingly, disclosed herein is a downhole equipment suspension system for a well with a production tree. The subsea production tree may be a vertical or horizontal tree. The suspension system may be used for connecting to any type of downhole equipment. For example, the downhole equipment may include a pump for pumping production fluids. Alternative embodiments of the suspension system are disclosed.

Figure 2A:
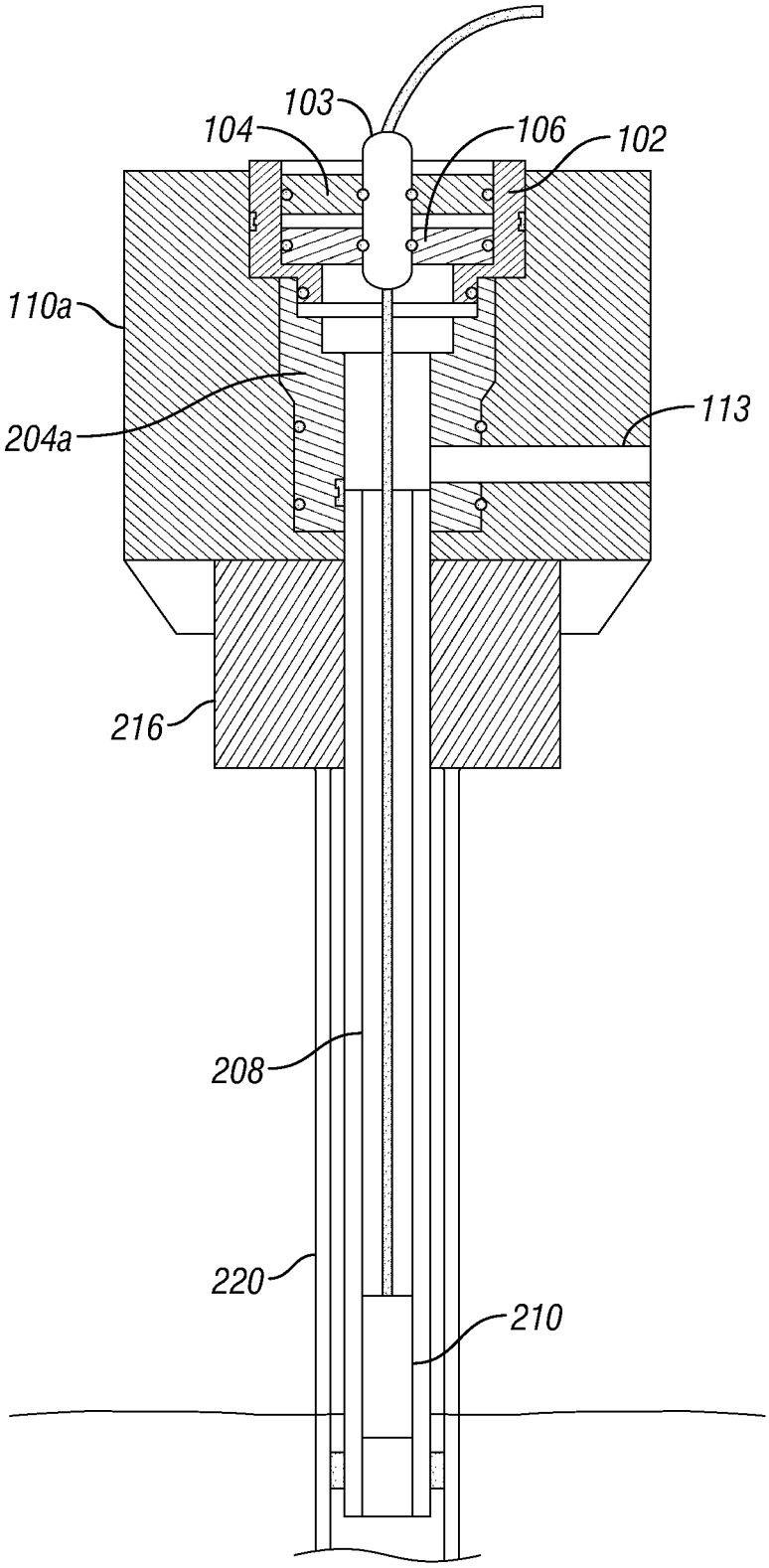
FIGS. 2A, 2B, and 2C show embodiments of a production system with a horizontal production tree and a downhole equipment suspension system.
Figure 2B:
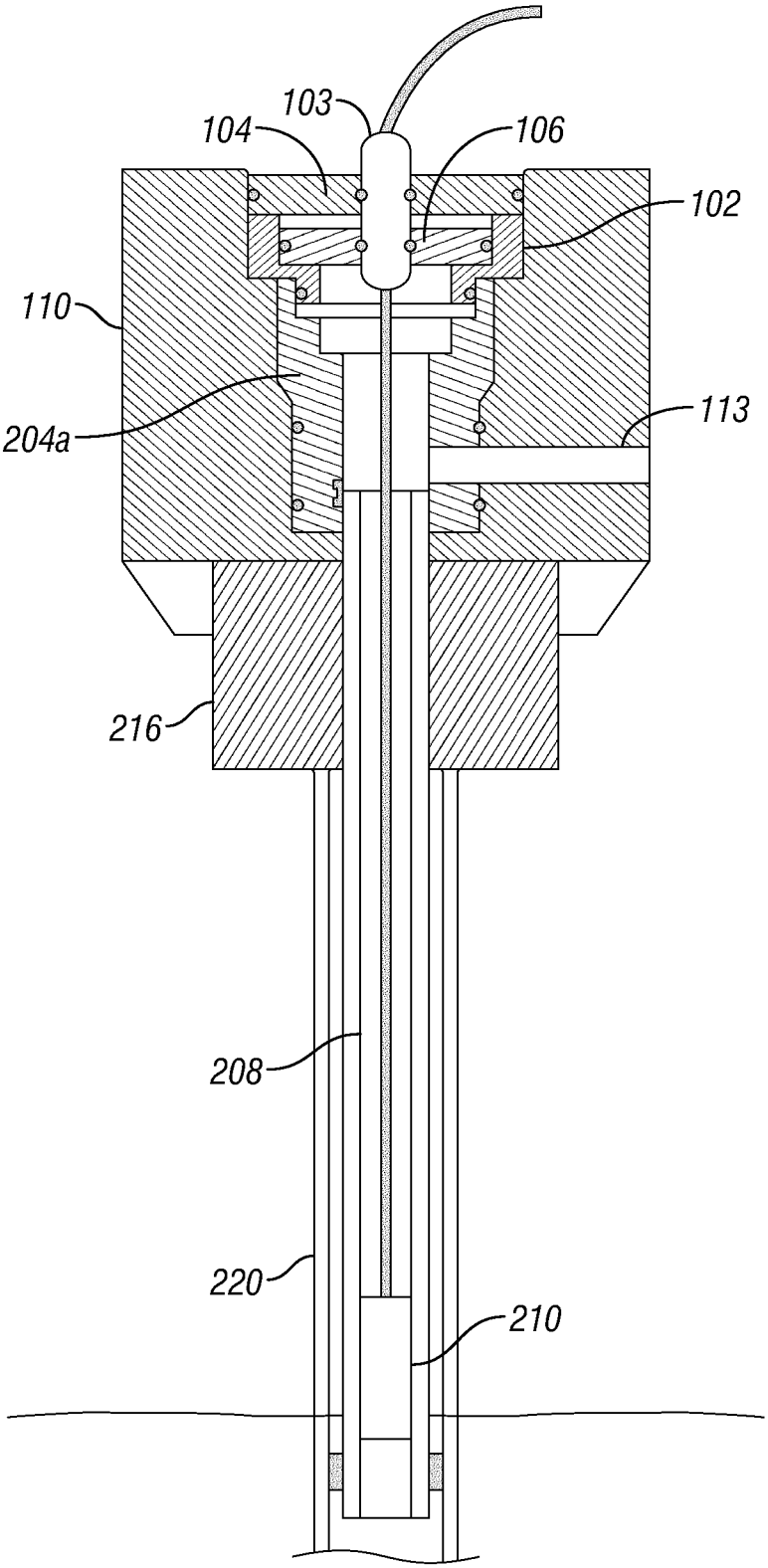
Figure 2C:
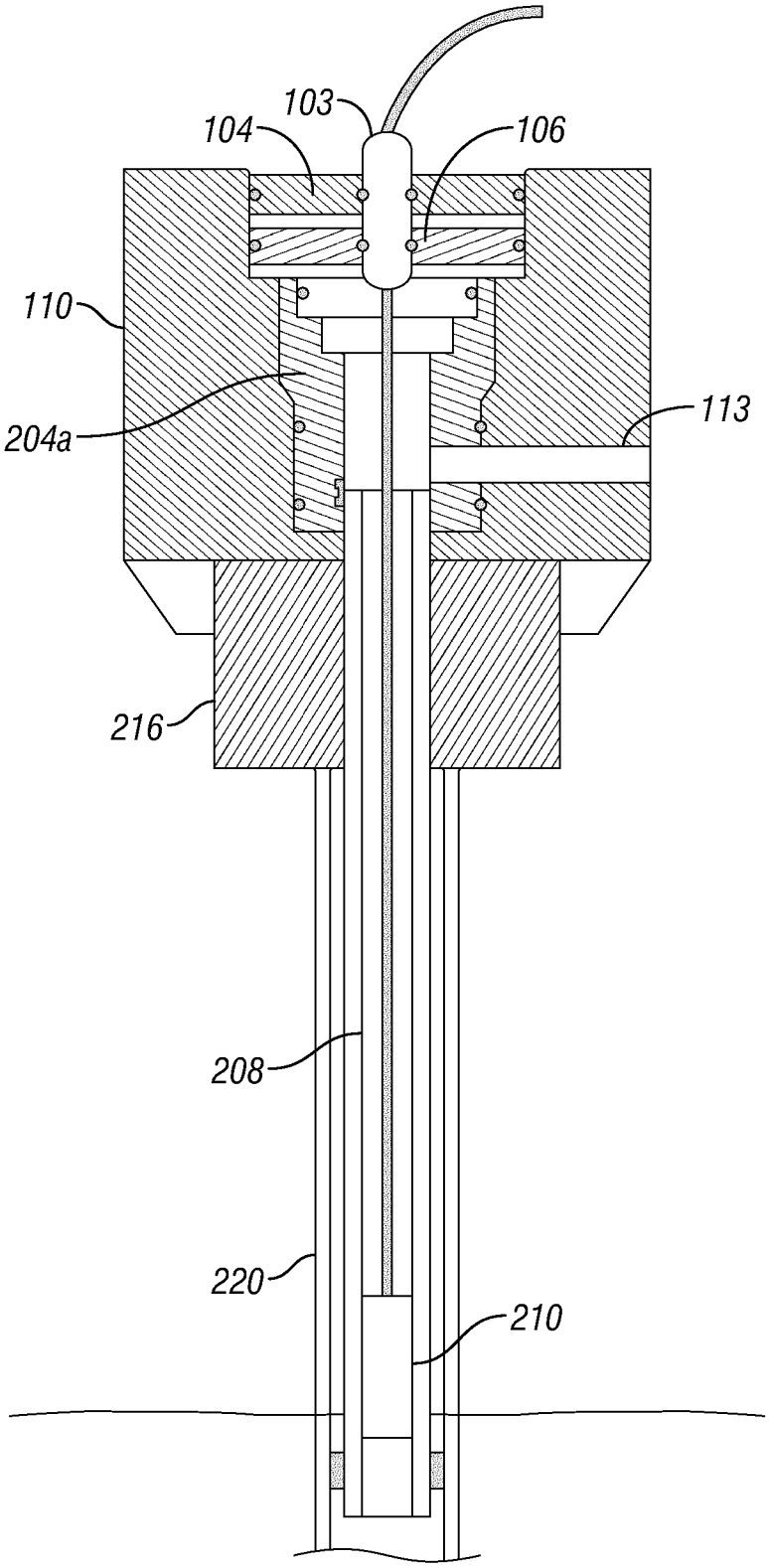

FIG. 1 is an illustrative embodiment of a subsea production system 101 including a subsea production tree 110 with a vertical bore. The production system 101 also includes a downhole equipment suspension system. In this embodiment, the subsea production tree shown is a subsea vertical monobore production tree 110 attached above a tubing head spool 202, which is connected with a wellhead 216. A tubing hanger 204 with a vertical production bore is landed in the tubing head spool 202 below the tree 110 and supports production tubing 208 extending into the well. As shown in FIGS. 2A-2C, a production casing 220 surrounds the production tubing 208, creating an annular area.

The downhole equipment suspension system includes a suspension head 106 supported directly or indirectly by the production tree 110 above and separately from the tubing hanger 204. As an example, the suspension head 106 shown lands and locks into the top of the tree body above the production swab valve 109 (PSV) and the production master valve 111 (PMV) as well as the lateral production bore 113. The suspension head 106 may also land in other locations as discussed below. A running tool is used to run, land, and lock the suspension head 106 into the production tree 110. The running tool may include an electrical connection to monitor continuity of power and signal electrical lines when running the suspension head 106 and also may provide access to the hydraulic lines controlling the emergency disconnect feature.

The suspension head 106 may also include control lines that may be operated and monitored during the pump deployment by a cable hanger running tool. The control lines also allow the bypass of fluid when landing the downhole equipment and/or flow around capabilities when the equipment is not in operation. The control lines may also include a twisted pair electric line to monitor downhole equipment performance such as pressure, temperature, and vibration.

The downhole equipment suspension system also includes downhole equipment 210 installed in the production tubing 208. The downhole equipment may be any type of equipment. For example, the downhole equipment 210 may include a pump operated by electrical power, hydraulic power, or both electrical and hydraulic power. The downhole equipment 210 may be installed with the production tubing 208 or after the production tubing 208 is installed.

The downhole equipment suspension system also includes a suspension line 107 that extends through the vertical production bores of the production tree 110 and the tubing hanger 204 and suspends downhole equipment 210 from the suspension head 106. The line 107 may include one or more electrical conductors, hydraulic conduits, and/or fiber optic cables. These conductors, conduits, and cables may also be encapsulated inside coil tubing for protection. The suspension line 107 may not require any internal pressure compensation. There is also an emergency disconnect function to disconnect the suspension line 107 from the downhole equipment 210 in the event that the downhole equipment 210 or suspension line 107 is stuck downhole and cannot be retrieved during installation and retrieval.

The downhole equipment suspension system also includes an assembly 102 in the production tree 110 that is separate than the tubing hanger 204. In the embodiment shown, the assembly includes an internal tree cap with flow capabilities that is landed and locked in the upper portion of the production tree 110 to act as one of the environmental barriers for the well. In this embodiment, the tree cap 102 includes an internal bore with an internal profile for a secondary lockdown assembly 104. Also in this embodiment, both the tubing head spool 202 and the production tree 110 include an annulus bypass 222 such that the annular area surrounding the production tubing 208 is in fluid communication with the vertical bore of the production tree 110 above the tubing hanger 204. The internal tree cap includes an annulus flow-by passage 224 in fluid communication with the annulus bypass 222 for establishing fluid communication with the annular area surrounding the production tubing 208 through the internal tree cap. Note that the internal tree cap shown is installable and retrievable by an ROV or by a drill pipe or similar landing string through a riser. The tree sub-assembly may also include hydraulically actuated chemical injection valves.

The suspension system also includes a flying lead assembly 103 that includes a debris cap and is ROV deployable. The flying lead assembly 103 is used for connecting an external power source 230 with the downhole equipment 210 in power communication through the suspension line 207. Various electrical connections may be used. As shown, a wet mate electrical connection is located at the bottom of the flying lead assembly 103 that interfaces with the suspension head 106. At the top, the debris cap provides debris protection and includes a high power electrical cable that is connected to a power supply such as a subsea distribution unit. If multiple cables are being connected, orientation may be required when mating the ROV deployable, flying lead connector assembly to a wet mate connection described below. Other connections may be used, including a continuous power connection between the external power source 230 and the downhole equipment 210.

In the embodiment shown in FIG. 1, the downhole equipment suspension system also includes the secondary lockdown assembly 104. The secondary lockdown assembly fits within and seals to the inside of the bore through the internal tree cap 102 above annulus access slots. Doing so provides an additional sealing and mechanical barrier above the suspension head 106. This allows for two barriers at all times, excluding the downhole lubricator valve or any downhole closures installed in the completion. The secondary lockdown assembly 104 requires no orientation during installation. The suspension head 106 may also include a wet mate connection for connecting with the flying lead assembly 103 through the secondary lockdown assembly 104 and the tree cap 102. To provide a barrier from the well, the secondary lockdown assembly 104 seals to the outside of the wet mate connection at the top of the suspension head 106. The wet mate connection from the suspension head 106 extends upward through the secondary lockdown assembly 104.

As shown as an example in FIG. 1, the production tree 110 may be installed on a tubing head spool 202. A tree isolation sleeve 112 isolates the annulus bore from the production bore and allows for pressure testing of the tree connector gasket while isolating the tubing hanger from the test pressure. Alternatively, the production tree 110 may be installed directly to a wellhead assembly 216. The top of the tree isolation sleeve 112 seals against the production tree 110 and the bottom of the isolation sleeve 112 seals against the tubing head spool 202. The tree isolation sleeve 112, for example, is rated for full system working pressure both internally and externally.

A production stab 114 provides primary and secondary sealing mechanisms, isolating the production bore from the annulus bore. The production stab 114 is constrained to the bottom of the tree body by the tree isolation sleeve 112. The top of the production stab 114 may seal against the tree body by means of a primary metal-to-metal seal and a secondary elastomeric seal. The bottom of the production stab 114 seals against the tubing hanger body by means of a primary metal-to-metal seal and secondary elastomeric seal. The production stab 114, for example, is rated for full system working pressure both internally and externally.

The tubing head spool assembly 202 is designed to land off and lock down to the wellhead assembly using any suitable connectors, such as lockdown connectors 206. This assembly also provides connecting interfaces for the tree and well jumper connectors. In addition, the tubing head spool assembly 202 provides a support structure for the assembly and an isolation sleeve that seals between the wellhead assembly 216 and tubing head spool assembly 202. The tubing head spool assembly 202 can be installed by either drill pipe or wire deployment systems with the assistance of an ROV.

The tubing head spool 202 body is a pressure containing cylindrical body, which is designed to act as a conduit between the wellhead 216 and the production tree 110. The tubing head spool 202 body may be designed for full system working pressure, for example Annulus access through the tubing head spool body is achieved by two intersecting angled flow bores 222. The tubing head spool 202 also contains an internal landing shoulder for the tubing hanger 204.

As noted above, the downhole equipment suspension system is installed in a production tree 110. In normal production mode without the suspension system install, the production tree 110 provides two separate barriers against the environment for both the production and annulus bores. The first barriers are the swab valves (PSV 109 and ASV 221) and the second barrier is the pressure containing internal tree cap. With the downhole equipment suspension system installed however, the production tree PSV 109 and PMV 111 are locked in the open position to avoid accidental closure on the cable/coiled tubing. Thus, the PSV 109 and PMV 111 are not available as environmental barriers. The suspension system susbstitutes for these valves by providing the necessary replacement barriers during production with the suspension head 106 and the secondary lockdown assembly 104. It should be noted that the production system, including the tree, tubing hanger, and production tubing may be installed with the suspension system from the beginning. In such a case, the downhole equipment and the cable/coiled tubing may be installed with the production tubing however service or replacement of downhole equipment requires retrieval of production tubing.

Because the PMV 111 is not available with the suspension system installed, a replacement master valve may be used instead. The production tree 110 thus may include a production wing valve block 115 including a wing bore 117 in line with and extending from the production tree lateral production bore 113. Although shown as separate, the production wing valve block 115 may either be separate from or integral with the production tree 110 body. Included along the tree lateral production bore 113 is a production outlet valve (POV) 120 that operates as and in similar manner to the PSV 109 for controlling fluid flow through the lateral production bore. To replace the PMV 111, a production wing valve 119 is included along the wing bore 117 that operates as and in a similar manner to the PMV 111 for controlling fluid flow through the lateral production bore.

In operation, the produced fluids are pumped upward from the well inside of the production tubing and outside of the coil tubing and then out through the tree lateral production bore 113 below the suspension head 106. The suspension system provides the necessary multiple environmental barriers and the production wing valve 119 acts as the replacement PMV. Power may be provided to the downhole equipment through the flying lead assembly 103 connection to the external power source 230, which may provide power as electrical, hydraulic, or both. Should the production tree 110 need to be removed for service, the suspension system, including the suspension line 107 and the downhole equipment 210 may be removed and appropriate barriers set in place. The production tree 110 may then be removed while leaving tubing hanger 204 and production tubing 208 in place.

There are multiple options available with the present invention. As shown in FIGS. 2A-C for example, the production tree may be a horizontal tree 110*a* connected with the wellhead 216. Valve and annulus ports (not shown) may also be included in the tree 110*a* in a similar manner as the production tree 110 shown in FIG. 1. Instead of being landed below the tree, a tubing hanger 204*a* is landed in a vertical bore of the tree itself. The tubing hanger 204*a* supports a production tubing 208 extending into the well and also includes a vertical bore in fluid communication with the bore of the production tubing. Extending laterally from the tree 110*a* is a lateral production bore 113. The tubing hanger 204*a* includes a passage extending laterally through the tubing hanger and aligned with the lateral production bore 113 such that production fluids may flow up the production tubing 208, through the tubing hanger 204*a*, and out the tree through the lateral production bore 113.

The suspension system in FIGS. 2A-2C are similar to the embodiment shown in FIG. 1 and includes a suspension head 106 suspending downhole equipment 210 in the production tubing with a suspension line. Also included is the flying lead assembly 103. As shown in FIG. 2A, a secondary lockdown assembly 104 and the suspension head 106 are landed in the internal tree cap 102 installed in the bore of the tree 110*a*. As shown in FIG. 2B, the secondary lockdown assembly 104 is landed directly in the production tree 110*a* and only the suspension head 106 is landed in the internal tree cap 102. As shown in FIG. 2C, both the secondary lockdown assembly 104 and the suspension head 106 are landed directly in the production tree 110*a*.

Figure 3:
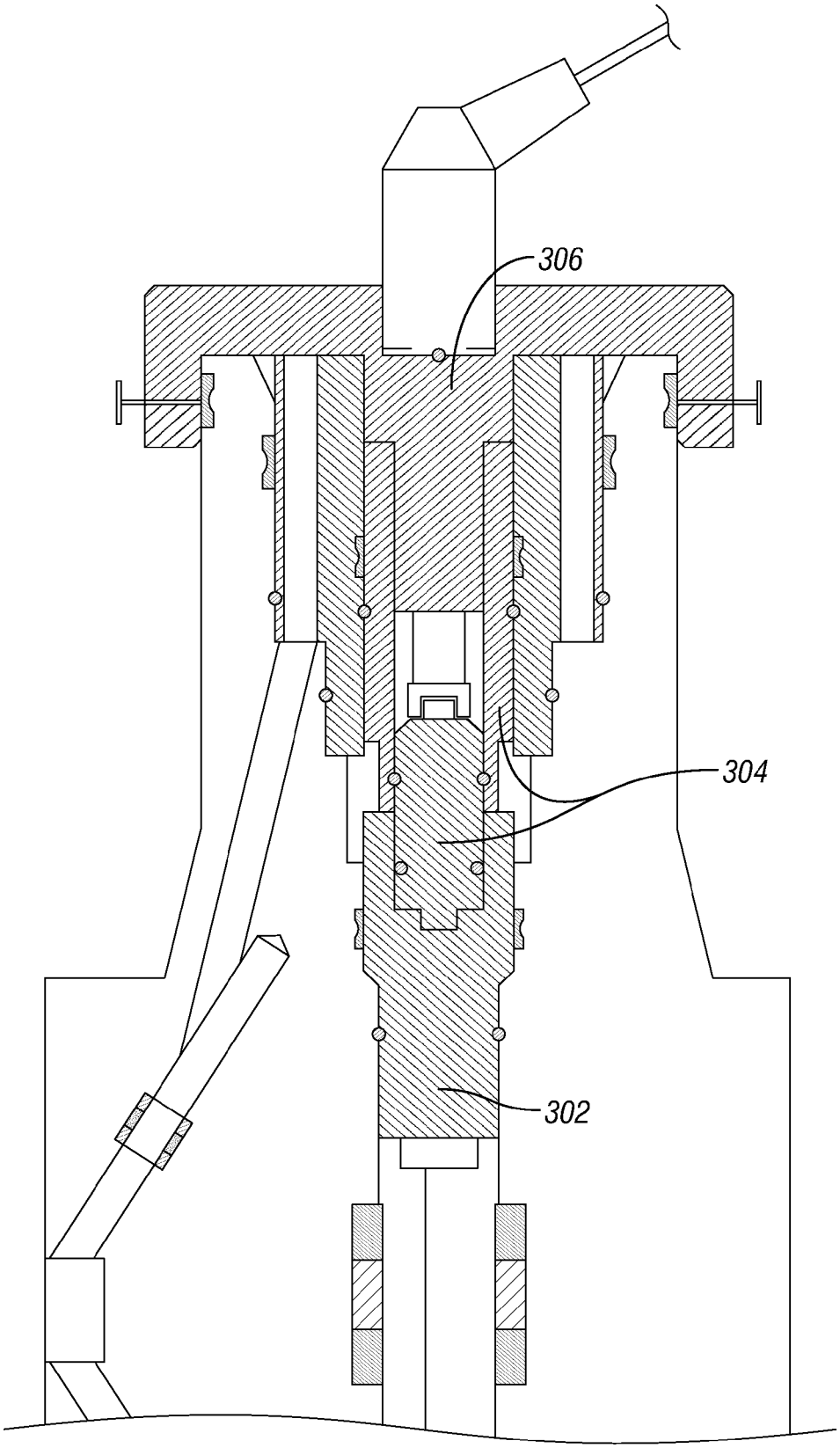
FIG. 3 shows an embodiment of components of the suspension system.

Also, the apparatus and method for providing the proper environmental barriers to the well in the top of the production tree 110 or 110*a* may take multiple suitable forms. For example, an embodiment shown in FIG. 3 can include three different components: a suspension head 302, an intermediate plug 304, and a flying lead 306. The suspension head 302 will be the primary pressure barrier with two testable seal barriers. It may also include an additional gallery seal that divides the two hydraulic lines that may pass thru the cable hanger and down into the coil tubing/cable. The suspension head 302 locks into the tree body and does not require orientation with respect to the tree. It may be installed under protection from the light well intervention (LWI) with a cable hanger running tool. It has a dry mate connection at the bottom and wet mate connection at the top.

The second component is the intermediate plug 304, which serves as the secondary pressure barrier with one testable seal barrier. The intermediate plug 304 may be oriented to the suspension head 302, locked to the internal tree cap, and sealed above annulus access. The intermediate plug 304 may be installed under the light well intervention protection with a cable hanger running tool. It has dual wet mate connections—at the bottom and top of the intermediate plug 304.

The third component is the flying lead 306, which serves as an environment/debris seal. The flying lead 306 seals into the internal tree cap below the light well intervention isolation sleeve preparation. The flying lead 306 may lock into the internal tree cap or onto the tree external connector profile. If required, it can be oriented to the intermediate plug 304 and deployed by an ROV tooling in open water. The flying lead 306 will have one wet mate connection. The advantages of this embodiment is having the intermediate plug as an additional barrier element to downhole valves before installing light well intervention when installing it, and before installing flying lead.

Figure 4:
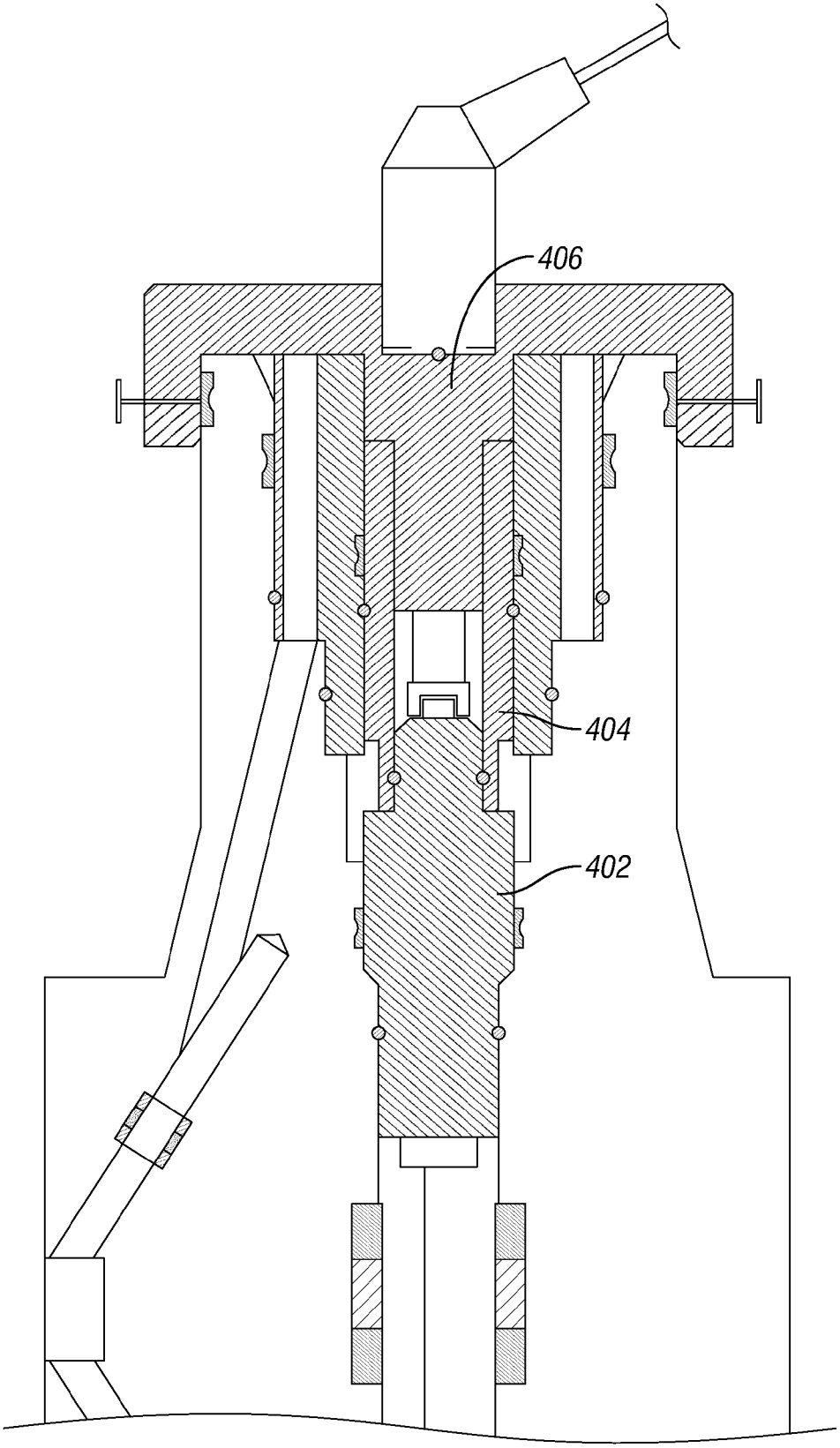
FIG. 4 shows another embodiment of components of the suspension system.

Another embodiment, as shown in FIG. 4, includes a suspension head 402 with an intermediate mandrel 404 and a flying lead 406. In this embodiment, the wet mate connection on top is extended upward through the mandrel 404 and directly connects to the flying lead 406. The intermediate mandrel 404 has one testable seal barrier between the metal end cap seal and one between the internal tree cap. The flying lead 406 will orient to the suspension head wet mate.

This embodiment has the advantage of eliminating a wet mate connection and its associated orientation. Another advantage is that there is independent lockdown to the suspension head 402.

Figure 5:
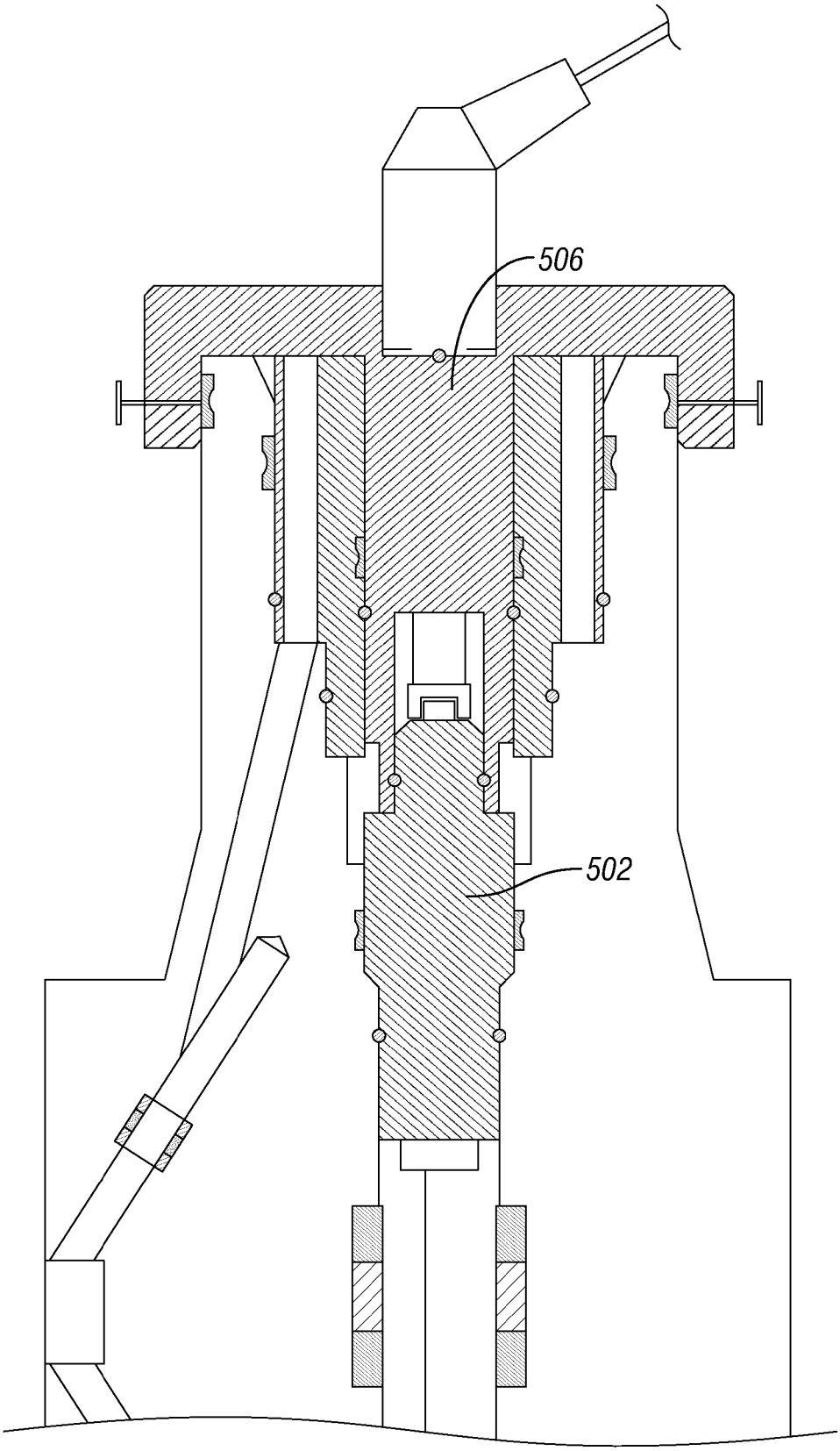
FIG. 5 shows yet another embodiment of components of the suspension system.

FIG. 5 illustrates another embodiment that is only applicable if the downhole lubricator and safety valve can be considered the primary barrier during installation of the downhole equipment. It includes two components: the suspension head 502 and the flying lead 506. There is no mandrel present. Despite the reliance on a downhole lubricator and safety valve as the primary barrier during installation, this embodiment has the advantage of reduced components, connections, and interfaces.

There are multiple advantages to the presented invention. Accordingly, one advantage is the flexibility in installation. As discussed above, there are various options for configuration and the use of multiple components. Another advantage of the present invention is the ability to employ a subsea vertical production tree, when typically horizontal trees have been considered the best arrangement for supplying electricity to and supporting downhole equipment. The suspension system provides the necessary barriers during production instead of the swab valve. The suspension system may be supplied as a two stage connection providing two seal barriers and independent mechanical barriers. Either section of the two can be located in the tree body or an internal tree cap having its own vertical bore sealed to the production tree vertical bore. When the suspension apparatus is not installed, the two valves in the vertical production bore can be opened and closed as normal and therefore used as barriers in a typical standard completion mode or workover.

Other embodiments of the present invention can include alternative variations. These and other variations and modifications will become apparent to those skilled in the art once the above disclosure is fully appreciated. It is intended that the following claims be interpreted to embrace all such variations and modifications.

What is claimed is:

1. A subsea production system for a well including:
a subsea production tree including a vertical bore;
a tubing hanger including a vertical production bore;
a tree cap coupled to the production tree;
a production tubing extendable into the well and supportable by the tubing hanger;
downhole equipment locatable downhole in the well; and
a downhole equipment suspension system including:
a suspension head supportable directly or indirectly by the production tree above and separately from the tubing hanger, the suspension head configured to provide a primary pressure barrier;
an intermediate plug distinct from the tree cap and configured to seal against the tree cap to provide a secondary pressure barrier above the primary pressure barrier of the suspension head; and
a suspension line extendable through the tubing hanger vertical production bore and the production tree vertical bore and configured to suspend the downhole equipment from the suspension head.

2. The system of claim 1, wherein the production tree is a vertical tree.

3. The system of claim 1, wherein the production tree is a horizontal tree.

4. The system of claim 1, wherein the suspension line includes at least one of an electrical conductor, a hydraulic conduit, and a fiber optic cable.

5. The system of claim 4, wherein the at least one of the electrical conductor, the hydraulic conduit, and the fiber optic cable is housed within a coiled tubing.

6. The system of claim 1, wherein the downhole equipment includes a pump operated by electrical power, hydraulic power, or both electrical and hydraulic power and the suspension line may be used to convey power to the pump.

7. The system of claim 1, further comprising the suspension head being landed in an assembly other than the tubing hanger, wherein the assembly is supportable by the production tree above and separately from the tubing hanger.

8. The system of claim 7, wherein the assembly comprises the tree cap.

9. The system of claim 8, wherein the tree cap includes an annulus flow-by passage for establishing fluid communication with an annular area surrounding the production tubing in the well.

10. The system of claim 7, wherein the assembly is a spool assembly other than the production tree.

11. The system of claim 1, further including:
a power source separate from the production tree; and
wherein the downhole equipment suspension system includes a flying lead assembly configured to connect the power source with the downhole equipment in power communication through the suspension line.

12. The system of claim 1, wherein the production tree includes:
a lateral production bore;
a production wing valve block including a wing bore extending from the lateral production bore; and
a wing master valve configured to control fluid flow through the wing bore.

13. The system of claim 12, wherein the production wing valve block is integral with or separable from the production tree and the wing bore is an extension of the lateral production bore.

14. The system of claim 1, wherein the downhole equipment suspension system includes one or more environmental barriers configured to isolate the well.

15. A downhole equipment suspension system for suspending downhole equipment in a subsea well with a subsea production tree including a vertical bore, a tree cap, a tubing hanger including a vertical production bore, and a production tubing extendable into the well and supportable by the tubing hanger, the system including:
a suspension head supportable directly or indirectly by the production tree above and separately from the tubing hanger, the suspension head configured to provide a primary pressure barrier;
an intermediate plug distinct from the tree cap and configured to seal against the tree cap to provide a secondary pressure barrier above the primary pressure barrier of the suspension head; and
a suspension line extendable through the tubing hanger vertical production bore and the production tree vertical bore and configured to suspend the downhole equipment from the suspension head.

16. The system of claim 15, wherein the suspension line includes at least one of an electrical conductor, a hydraulic conduit, and a fiber optic cable.

17. The system of claim 16, wherein the at least one of the electrical conductor, the hydraulic conduit, and the fiber optic cable is housed within a coiled tubing.

18. The system of claim 15, wherein the downhole equipment includes a pump operated by electrical power, hydraulic power, or both electrical and hydraulic power and the suspension line may be used to convey power to the pump.

19. The system of claim 15, further comprising the suspension head being landable in an assembly other than the tubing hanger, wherein the assembly is supported by the production tree above and separately from the tubing hanger.

20. The system of claim 19, wherein the assembly comprises the tree cap.

21. The system of claim 20 wherein the tree cap includes an annulus flow-by passage for establishing fluid communication with an annular area surrounding the production tubing in the well.

22. The system of claim 19, wherein the assembly is a spool assembly other than the production tree.

23. The system of claim 15, further including:

a power source separate from the production tree; and wherein the downhole equipment suspension system includes a flying lead assembly configured to connect the power source with the downhole equipment in power communication through the suspension line.

24. The system of claim 15, wherein the downhole equipment suspension system includes one or more environmental barriers configured to isolate the well.

25. A subsea production system for a well including:

a subsea production tree including a vertical bore and a lateral bore;

a tubing hanger including a vertical production bore;

a tree cap coupleable to the production tree;

a production tubing extendable into the well and supportable by the tubing hanger; and a downhole equipment suspension system including:

a suspension head supportable directly by the production tree above and separately from the tubing hanger, the suspension head configured to provide a primary pressure barrier;

a suspension line extendable through the tubing hanger vertical production bore and the production tree vertical bore and configured to suspend downhole equipment from the suspension head; and an intermediate plug configured to seal against the suspension head and provide a secondary pressure barrier.

26. The system of claim 25, wherein the production tree is a vertical tree.

27. The system of claim 25, wherein the production tree is a horizontal tree.

28. The system of claim 25, further comprising:

a production wing valve block coupled to and separable from the subsea production tree, the production wing valve block including a wing bore extending from lateral bore and a valve located within and configured to control fluid flow through the lateral bore.

* * * * *